US011453189B2

(12) United States Patent
Jenter et al.

(10) Patent No.: US 11,453,189 B2
(45) Date of Patent: Sep. 27, 2022

(54) DEVICE FOR COMPRESSION OF EMPTIED CONTAINERS FOR RECYCLING PURPOSES

(71) Applicant: Tomra Systems ASA, Asker (NO)

(72) Inventors: Holger Jenter, Balingen-Heselwangen (DE); Thomas Völkle, Rosenfeld-Täbingen (DE); Marius Fraurud, Oslo (NO); Kristian Hovde, Oslo (NO)

(73) Assignee: TOMRA SYSTEMS ASA, Asker (NO)

( * ) Notice: Subject to any disclaimer, the term of this patent is extended or adjusted under 35 U.S.C. 154(b) by 0 days.

(21) Appl. No.: 17/424,677

(22) PCT Filed: Jan. 31, 2020

(86) PCT No.: PCT/EP2020/052500
§ 371 (c)(1),
(2) Date: Jul. 21, 2021

(87) PCT Pub. No.: WO2020/157317
PCT Pub. Date: Aug. 6, 2020

(65) Prior Publication Data

US 2022/0097332 A1 Mar. 31, 2022

(30) Foreign Application Priority Data

Jan. 31, 2019 (EP) ..... 19154899

(51) Int. Cl.
*B30B 9/32* (2006.01)
*B30B 3/00* (2006.01)
*B30B 3/04* (2006.01)

(52) U.S. Cl.
CPC ..... *B30B 9/325* (2013.01); *B30B 3/005* (2013.01); *B30B 3/04* (2013.01)

(58) Field of Classification Search
CPC ..... B30B 3/005; B30B 9/325; B02C 4/30; B02C 4/08; B02C 19/0093
See application file for complete search history.

(56) References Cited

U.S. PATENT DOCUMENTS 4,252,282 A 2/1981 Vermeulen et al.
7,540,231 B2 * 6/2009 Hofmann ..... F15B 11/024 91/436

(Continued)

FOREIGN PATENT DOCUMENTS

EP 2756946 A1 7/2014
JP S4928255 U 3/1974

(Continued)

OTHER PUBLICATIONS

International Preliminary Report on Patentability (PCT/IPEA/409) dated May 28, 2021, by the European Patent Office as the International Preliminary Examining Authority for International Application No. PCT/EP2020/052500.

(Continued)

*Primary Examiner* — Gregory D Swiatocha
(74) *Attorney, Agent, or Firm* — Buchanan Ingersoll & Rooney P.C.

(57) ABSTRACT

A device for compression of emptied containers, the device for compression of emptied containers including a container compressing arrangement provided with a first and a second roller, each roller having annular segments provided with specially shaped protruding elements. The device is for compression of plastic bottles as well as metal cans.

26 Claims, 12 Drawing Sheets

(56) References Cited

U.S. PATENT DOCUMENTS

| | | | | |
|---|---|---|---|---|
| 7,556,213 | B2 * | 7/2009 | Schwelling | B02C 19/0081 241/166 |
| 2012/0137904 | A1 * | 6/2012 | Vandewinckel | B30B 9/325 100/98 R |
| 2014/0196616 | A1 * | 7/2014 | Schwelling | B30B 3/045 100/155 R |

FOREIGN PATENT DOCUMENTS

| | | | |
|---|---|---|---|
| JP | 3025701 | U | 6/1996 |
| WO | 2017140863 | A1 | 8/2017 |
| WO | 2018167060 | A1 | 9/2018 |

OTHER PUBLICATIONS

International Search Report (PCT/ISA/210) and Written Opinion (PCT/ISA/237) dated Jun. 2, 2020, by the European Patent Office as the International Searching Authority for International Application No. PCT/EP2020/052500.

Written Opinion (PCT/IPEA/408) dated Feb. 23, 2021, by the European Patent Office as the International Preliminary Examining Authority for International Application No. PCT/EP2020/052500.

* cited by examiner

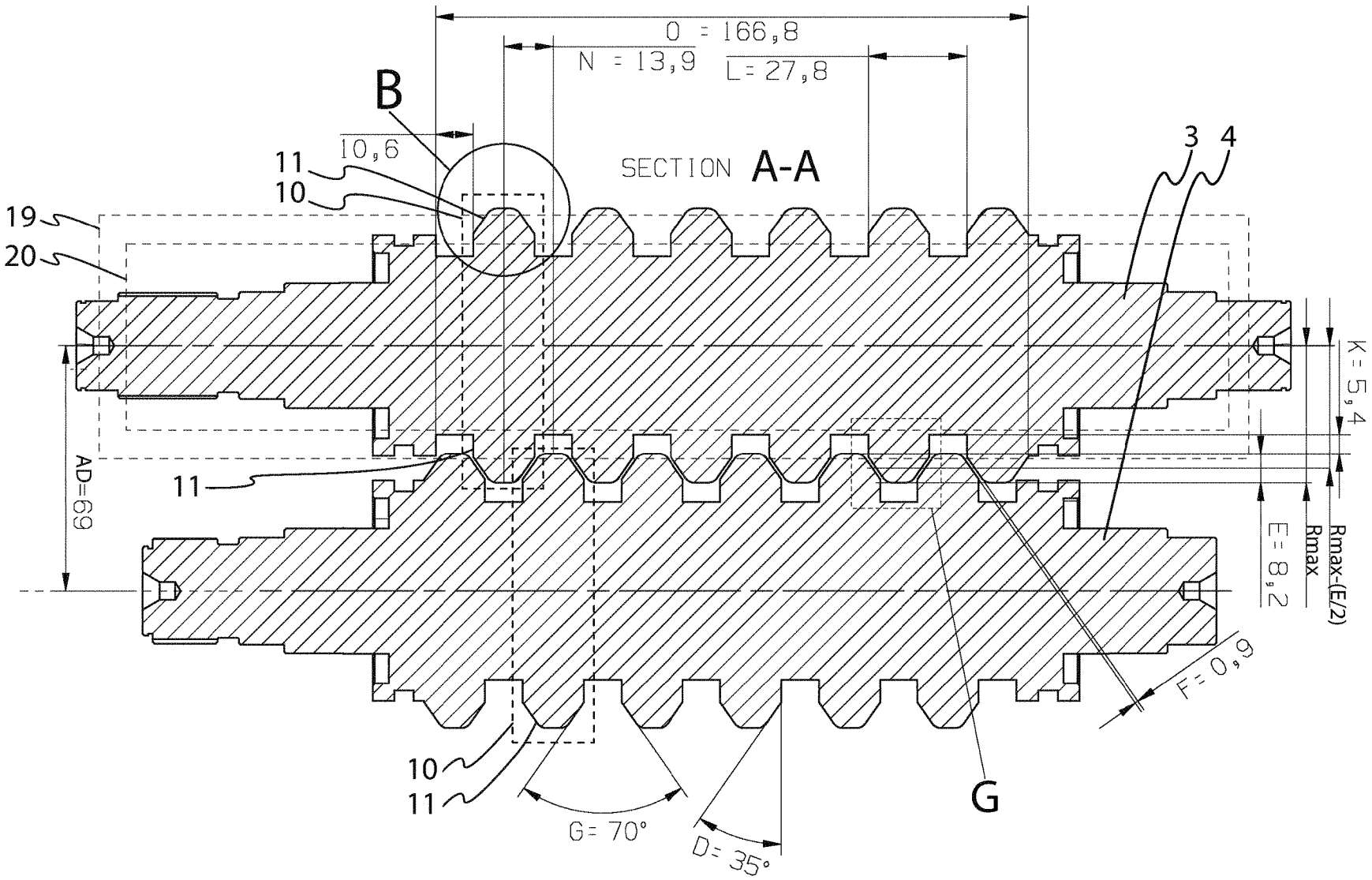
Fig. 4 M = 0°

M= 22,5°

DEVICE FOR COMPRESSION OF EMPTIED CONTAINERS FOR RECYCLING PURPOSES

TECHNICAL FIELD

The present invention relates to a device for compression of emptied containers for recycling purposes. More specifically, the present invention relates to the geometries and arrangement of rollers for compression of emptied containers.

BACKGROUND

Reverse vending machines are generally arranged so that a person can return empty containers, and in some cases receive some money in return. The reverse vending machine may collect a large number of containers in a short period of time. This means that the reverse vending machine needs to be very efficiently storing the containers so that the storage bin for the containers need not be replaced too frequently. Therefore, the containers are compressed by the reverse vending machine so that they each take up less space than before being compressed.

Since reverse vending machines generally supply money to a person in return to the received containers, they are also subject to fraud. Thus, the reverse vending machine should preferably have a way of marking a container e.g. a bottle or a can such that money is not returned more than once for a single container.

In order to compress the containers, the reverse vending machines typically have pressure rollers which have two main tasks, grabbing the container and then compress it between two rollers. The pressure rollers must compress the containers in such a way that they stay flattened after they are released from the pressure rollers. Thus, it is desirable to be able to mark the containers in a way such that it is destructed, and at the same time ensure that the container stays flat after being released from the pressure roller.

An example of an apparatus comprising pressure rollers is disclosed by US20140196616. However, the apparatus disclosed in US20140196616 has a rather short life time due to rather quickly being worn. This causes e.g. a standstill of the machine after relatively short operation time.

Other examples of apparatuses comprising rollers are disclosed in EP2756946A1, JP 3 025701 U, JP S49 28255 U, and U.S. Pat. No. 4,252,282 A.

A drawback of prior art roller arrangements is that they are not well suited for processing containers of varying material and shape, such as metal cans and plastic bottles, in one and the same machine. A specific problem is that packages compressed are stuck in the machine causing a jam, which requires manual attendance by an operator in order to allow for continued operation. Such manual attention takes time and therefore costs money for operators of the machines. Standstills are also annoying for consumers returning used containers.

In view of at least the above discussed drawbacks, there is a need for an improved way of handling containers in reverse vending machines.

SUMMARY

Accordingly, an object of the present disclosure is to provide technology allowing one single machine for compaction of empty containers, such as a reverse vending machine, to handle packages of metal, plastic, paper and/or cardboard, such as metal cans or plastic bottles, whilst reducing the risk of jam and other running problems. Although the most common containers are drinking containers, the present device is also suitable for other types of containers such as containers for consumer goods, containers for food and/or beverages such as milk cartons or containers for shampoo, cosmetics and household chemicals, including PET containers, aluminum containers and steel containers.

These and other objects achieved by a device for compression of emptied containers as defined in the appended independent claim with alternative embodiments set forth in the dependent claims.

Specifically, these objects are achieved by a device for compression of emptied containers for recycling purposes, said device comprising a container compressing arrangement. The container compressing arrangement comprises: a first and a second rotatable roller, wherein each of said first and second rotatable rollers is configured to rotate in a respective direction of rotation, around a respective rotation axis. Also, the first and second rollers are arranged adjacent to each other and with the rotational axes, in parallel. The direction of rotation of said first roller is opposite to the respective direction of rotation of said second roller so that the first and second rollers cooperate in the feeding of containers between the rollers. Each of said first and second rollers comprises annular segments, arranged spaced apart in succession along the length of the respective roller in an axial direction coinciding with said respective rotation axis. Each of said annular segments of said first roller extends between a respective pair of said annular segments of the second roller. Each of said annular segments of said second roller extends between a respective pair of said annular segments of said first roller. Each annular segment comprises: protruding elements arranged in succession circumferentially around the respective roller. Each protruding element comprises a base from which the protruding element extends radially outwards. Also, each protruding element comprises a leading surface, a trailing surface arranged after said leading surface in the respective direction of rotation, a top surface connecting said leading surface and said trailing surface, and a first and a second side surface respectively arranged on opposite sides of each protruding element with respect to the rotation axis of the first roller. The top surface is the surface comprising the radially outermost point of each protruding element 11. Further, each of said leading surface, said top surface and said trailing surface is planar or single curved. Also, the junction between said leading surface and said top surface forms a first ridge for urging the emptied containers between said rollers. Further, each of the protruding elements of one of said first and second rollers is arranged to pass between a respective pair of annular segments of the other of said first and second rollers. Also, $E=2*Rmax-AD$, where E is the engagement value, Rmax is the maximum radius of the roller within said protruding element and AD is the distance between the respective rotation axis of said first and second rollers. Each of said side surfaces comprises a slanting portion, which slanting portion is slanting outwards from said top surface towards said base and $Lslanting>0.5*E$, where Lslanting is the length of the slanting portion in a center plane intersecting the center of said top surface and the rotation axis of the roller.

According to one example, said first and second side surface and said leading and trailing surface together from two pairs of opposite surfaces of said protruding element. The leading surface and the trailing surface are arranged on opposite sides of said protruding element in the rotational direction of the roller on which they are arranged. The first and second side surface are arranged on opposite sides of said protruding element in the longitudinal direction of the roller. In other words, said leading surface and said trailing surface are arranged on opposite sides of said protruding element relative a plane coinciding with the center plane and said first side surface and said second side surface are arranged on opposite sides of said protruding element relative a plane orthogonal to said center plane and intersecting the center of said top surface.

The device 1 for compression of emptied containers may further be configured such that:

TWmiddle>0.8*GWmiddle, where TWmiddle is the distance between the first and second side surface in the axial direction of the protruding element at a distance equal to Rmax−E/2 from the rotation axis of said roller in said center plane;

and GWmiddle is the shortest distance in the axial direction between said pair of annular segments between which said protruding element is arranged to pass, said shortest distance being determined at a distance equal to Rmax−E/2 from the rotation axis of the roller on which said pair of annular segments is arranged. In other embodiments, TWmiddle>0.9*GWmiddle or TWmiddle>0.95*GWmiddle.

Also, the length of said overlap of said slanting portion may be at least 2.5 mm when the rollers are arranged with maximum overlap between two adjacent annular segments. Additionally, or alternatively, the separation distance between said slanting portions which are facing each other may be at least 0.4 mm and at most 3.0 mm.

An outer portion of said protruding element may have a smooth profile in said center plane. A smooth profile is formed by a selection from only flat surfaces, rounded surfaces and corners with corner angle larger than 120, 150 or 170 degrees.

A tip portion of said protruding element may have a smooth profile in said center plane. A smooth profile is formed by a selection from only flat surfaces, rounded surfaces and corners with corner angle larger than 120, 150 or 170 degrees.

The outer portion of each protruding element is defined as the portion between Rmax and Rmax−(E).

The tip portion of each protruding element is defined as the portion between Rmax and Rmax−(E/2).

The leading surface may comprise a planar portion, which planar portion extends in a plane comprising said axial direction, wherein the planar portion forms an angle within the range of 0° to 20° to the radial direction in the direction of rotation, examples of said range of angles being at least 0°, at least 4° or at least 8°; and/or said angle being at most 20°, 16° or 12°.

The slanting portion may comprise a planar portion, which planar portion extends in a plane transverse to said axial direction, wherein said planar portion forms an angle within the range of 25° to 45° to the radial direction.

The top surface may have a length in said axial direction of at least 1.8 mm or at least 2.8 mm or at least 3.8 mm; and/or the top surface may have a length in said axial direction of at most 6.0 mm or at most 5 mm or at most 4.0 mm.

The top surface may be connected to said side surfaces by a respective convex surface, said convex surface optionally having a radius of curvature of at least 1 mm or at least 2 mm or at least 2.5 mm; and/or said radius of curvature is at most 5 mm or at most 4 mm or at most 3.5 mm.

The planar portion of said side surface may have a length of at least 4.0 mm or at least 6.0 mm or at least 7.0 mm in the center plane; and/or said side surface may have a length of at most 11.0 mm or at most 8.5 mm or at most 7.5 mm in the center plane.

The difference in radial height between the highest and lowest surface of the annular segment in the center plane may be at least 6.5 mm or at least 8.5 mm or at least 9.5 mm. Additionally or alternatively, the difference in radial height between the highest and lowest surface of the annular segment in the center plane may be at most 15.0 mm or at most 13.0 mm or at most 11.0 mm.

The center-to-center distance of two adjacent annular segments on the same roller may be at least 12 mm or at least 20 mm or at least 27 mm; and/or wherein the center-to-center distance of two adjacent annular segments on the same roller is at most 44 mm or at most 36 mm or at most 29 mm.

The ratio between the height of the protruding element and the width of the protruding element in the axial direction is at least 0.5 or at least 0.6 or at least 0.7; and/or wherein the ratio between the height of the protruding element and the width of the protruding element in the axial direction is at most 1.2 or at most 1.0 or at most 0.8.

The engagement value E may be at least 4.0 mm or at least 6.0 mm or at least 7.0 mm, and/or the engagement value E may be at most 12.5 mm, or at most 10.5 mm or at most 10.2 mm.

The area of a cavity formed between two adjacent annular segments of said first roller and a meshing protruding element of said second roller may be within the range of 50 to 170 mm2 when the rollers are arranged with maximum overlap.

Each of said first and second rollers may, in use, have an offset angle (M) of at least 0° or at least 8° or at least 20°; and/or each of said first and second rollers may, in use, have an offset angle of at most 33° or at most 28° or at most 23°.

The engagement value between two adjacent protruding elements when the rollers are arranged with maximum overlap may be at least 4.0 mm or at least 6.0 mm or at least 7.0 mm, and/or the engagement value between two adjacent protruding elements when the rollers are arranged with maximum overlap may be at most 12.5 mm, or at most 10.5 mm or at most 10.2 mm.

The engagement value corresponds to the meshing depth or the overlap between the protruding elements when the radial offset M is 0 degrees. However, the actual radial offset M when the compaction arrangement is assembled and ready for use may be set to any predetermined value as described herein. When M is different from 0, the actual overlap may defer from the value E.

Another object is to improve feeding of plastic containers towards a gap between two compression rollers. This object is achieved with a paddle according to the new paddle design described below with reference to FIGS. 19-22.

BRIEF DESCRIPTION OF DRAWINGS

FIGS. 1-15 all relate to a first embodiment of the present disclosure, however with varying angular offset M between the rollers, as shown in FIGS. 7 and 8. FIGS. 1, 2, 16, 8, 17, and 15 shows a configuration in which M=22.5° whilst the other figures show a configuration in which M=0°.

FIG. 1 shows a schematic side view of a device for compression of emptied containers for recycling purposes, said device including a pair of rollers for compression of the containers. This figure also defines region E.

FIG. 2 shows a front view of the pair of rollers also shown in FIG. 1.

FIG. 3 shows a side view of the rollers and defines regions C, D and cross section A-A used in other figures.

FIG. 4 shows a cross sectional view in cross section A-A as defined in FIG. 3.

FIG. 5 shows detail view B depicting a protruding element of a roller as seen in cross section A-A of FIG. 4.

FIG. 6 shows detail view C depicting a protruding element of a roller as seen from the side.

FIG. 7 shows detail view D of the pair of rollers shown in FIG. 4 with a relative angular offset between the rollers of M=0°.

FIG. 8 shows detail view E of the pair of rollers shown in FIG. 15 with a relative angular offset between the rollers of M=22.5°.

FIGS. 9-14 show use of the device for compression of an empty PET bottle, wherein FIGS. 9-11 show the bottle aligning with the rollers and FIGS. 12-14 show the bottle transversal to the rollers. Also, although FIGS. 9-14 show only one paddle for feeding of the rollers, three paddles are provided, as shown in FIG. 1.

FIG. 15 shows a pair of rollers as seen in cross-section F-F defined in FIG. 16.

FIG. 16 corresponds to FIG. 3 but shows the rollers with relative angular offset of 22.5°. This figure also defines cross section F-F.

FIG. 17 shows enlarged detail view G as defined in FIG. 4 for M=0°.

Figure 1:
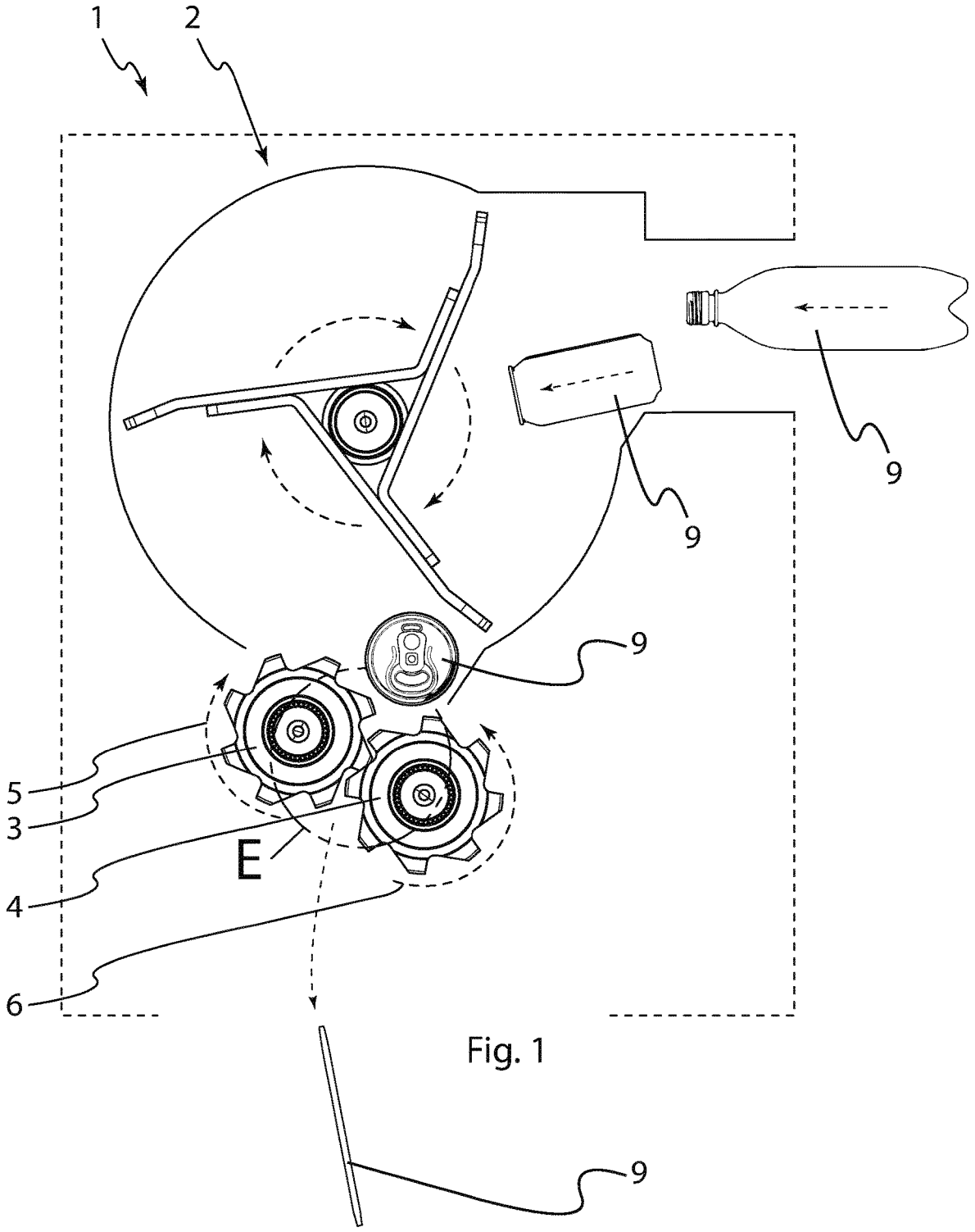

| | |
|---|---|
| 1 | device for compression of emptied containers |
| 2 | container compressing arrangement |
| 3 | first roller |
| 4 | second roller |
| 5 | first direction of rotation |
| 6 | second direction of rotation |
| 7 | first rotation axis |
| 8 | second rotation axis |
| 9 | container |
| 10 | annular segment |
| 11 | protruding elements |
| 12 | leading surface |
| 13 | trailing surface |
| 14 | top surface |
| 15 | first side surface |
| 16 | second side surface |
| 17 | slanting portion |
| 18 | base of protrusion |
| 19 | center plane |
| 20 | plane comprising axial direction |
| 21 | angle to the radial direction |
| 22 | first ridge |
| 23 | base surface of roller |
| 24 | paddle |
| 25 | cross-sectional area |
| 26 | spaced-apart recesses of paddle |
| 27 | feeding tooth of paddle |

DETAILED DESCRIPTION

An embodiment of a device 1 for compression of emptied containers 9 for recycling purposes will hereinafter be described with reference to the appended drawings. Also, the dimensions stated in the drawings are given in millimeters and for the specific embodiment illustrated but may vary as described herein. It should be understood that changing one dimension usually requires adaptation of one or more other dimensions. The embodiment illustrated in the drawings is drawn to scale, however with varying scale between different figures.

The device is intended to be positioned in stores for reverse vending of metal cans and plastic bottles for recycling purposes. The device 1 receives empty containers 9 and compresses the containers 9 so that many containers can be stored and handled using little space.

FIG. 1 shows the device 1 when in use for compressing containers 9 of varying shape and material. As shown, the device 1 handles both metal cans and plastic bottles. As shown in FIGS. 9-14, the device is also able to handle differently oriented containers 9.

The device 1 comprises a container compressing arrangement 2 comprising a first roller 3 and a second roller 4 operating together to compress a container 9 by feeding the container 9 between the rollers 3, 4. In this embodiment, three paddles 24 are provided above said rollers 3, 4 for feeding containers 9 from an inlet of the device 1 towards the rollers 3, 4. However, in FIGS. 9-14 only one paddle 24 is illustrated although three paddles 24 are provided. In other embodiments, fewer or more paddles 24 may alternatively be provided.

Each of the first 3 and second 4 rotatable rollers is configured to rotate in a respective direction of rotation 5, 6 around a respective rotation axis 7, 8. The rollers 3, 4 are driven by a drive mechanism powered by a suitable drive means such as an electric motor (not shown). The first 3 and second 4 rollers are arranged adjacent to each other and with the rotation axes 7, 8 in parallel. The first roller 3 is operated in opposite direction of rotation 6 to the direction of rotation of the second roller 4 so that the first 3 and second 4 rollers cooperate in the feeding of containers 9 between the rollers 3, 4.

Figure 11:
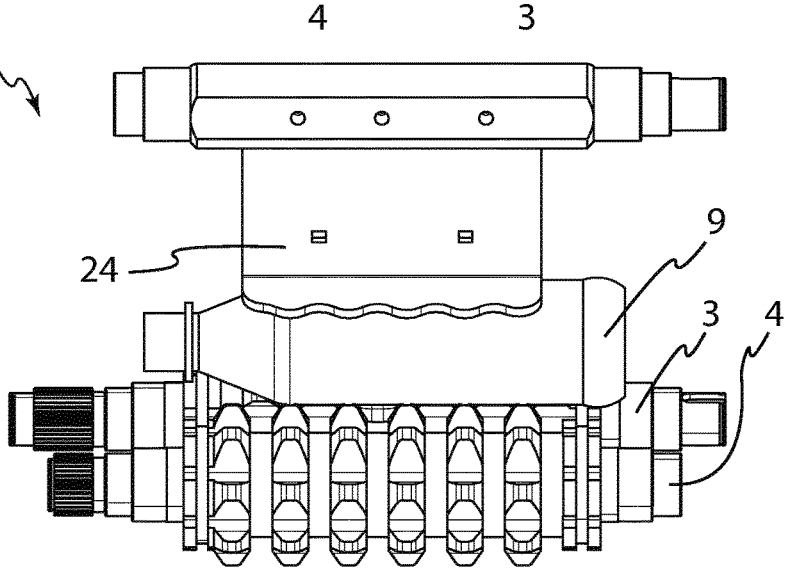
Figure 12:
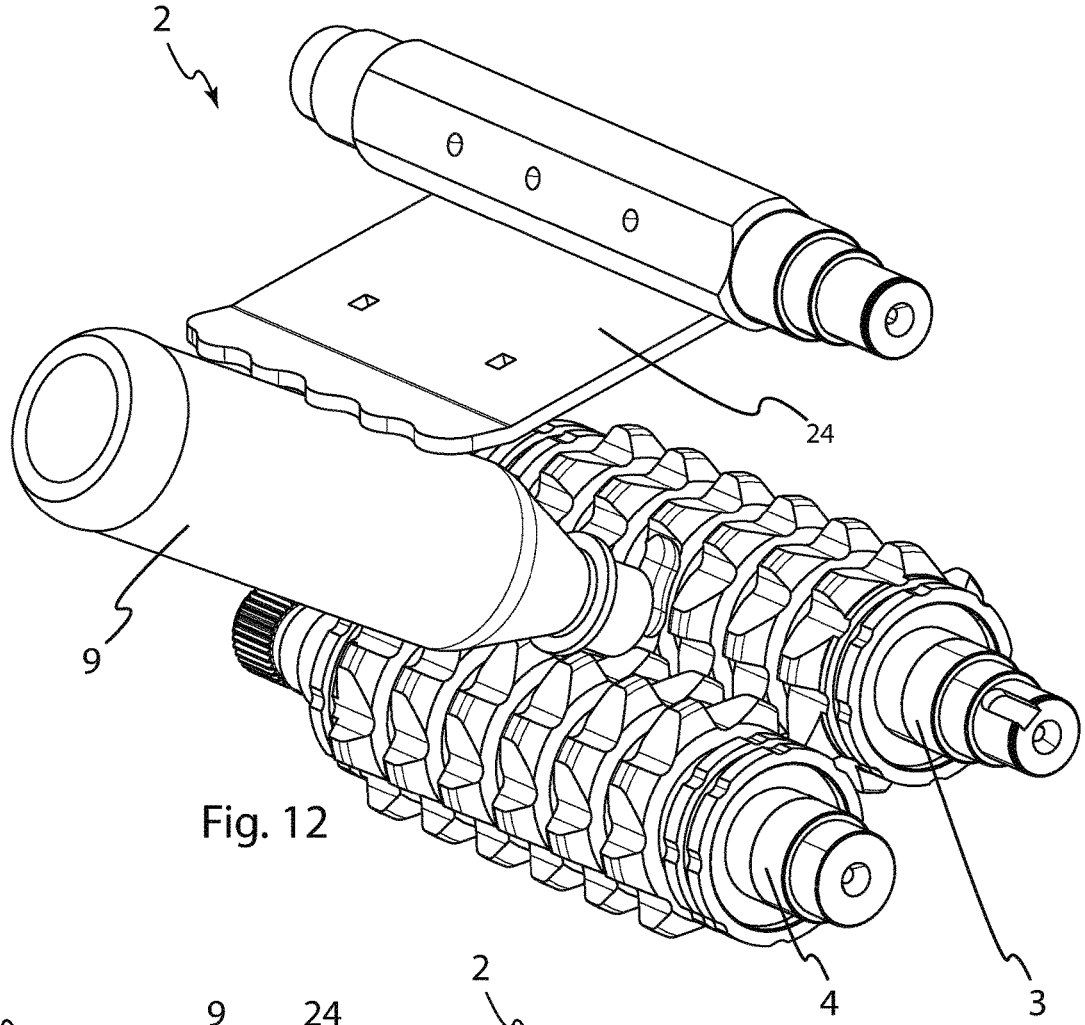
Figure 13:
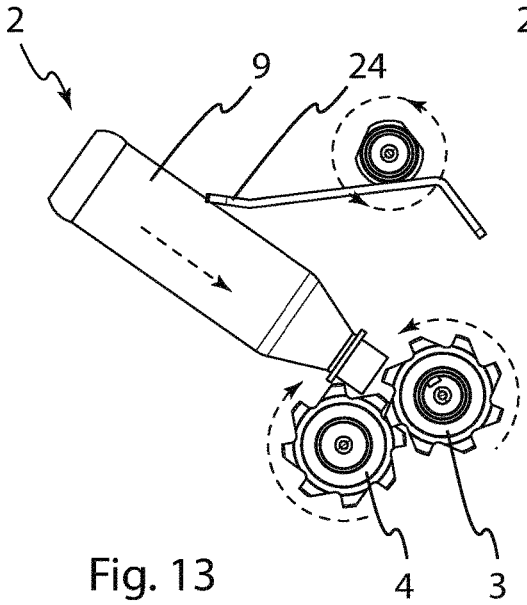
Figure 14:
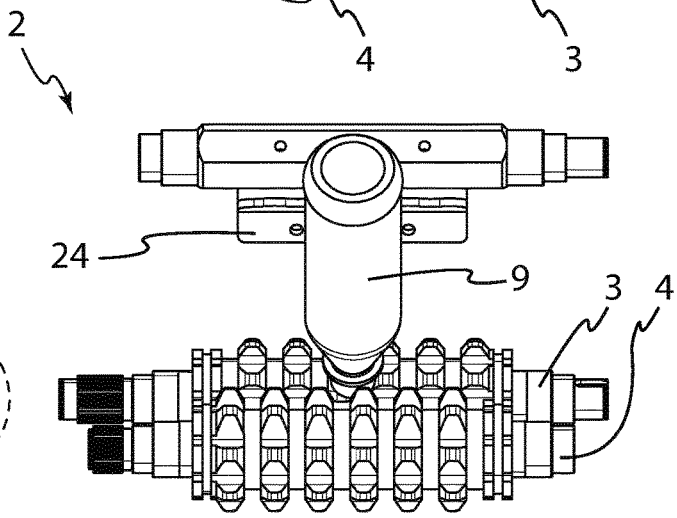

As visible in FIG. 11, the outer edge of each paddle 24 is wave-shaped with recesses adapted such that the paddle can extend between protruding elements 11 of the second roller 4 without touching the second roller 4. The wave-shaped recesses allow for the paddle 24 to work closer to the second roller 4 for forcing the container 9 in between the rollers 3, 4.

The distance between the first 3 and second 4 rollers as well as the shape of the rollers 3, 4 greatly affect the result of the feeding and compressing action on the containers 9. Whilst some reverse vending machines are made for cutting the containers at compression, the present device 1 is configured to compress the containers 9 with less cutting. It has been found that less cutting of the containers 9 sometimes makes the device 1 less prone to jamming of containers between the rollers. The present compression device 1 mainly cuts at the ridge 22 between the leading surface 12 and the top surface 14.

Figure 2:
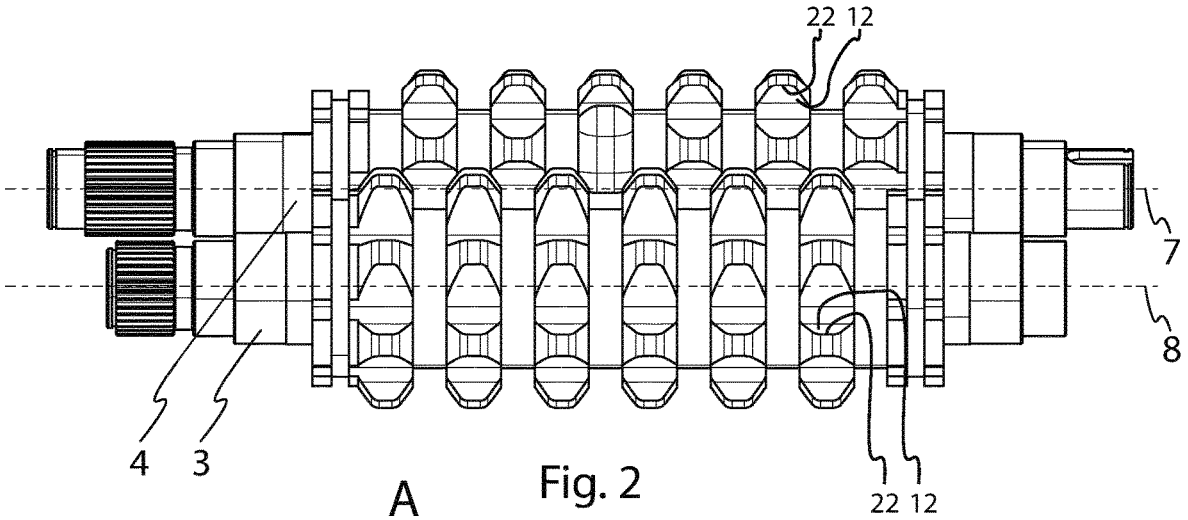
Figure 3:
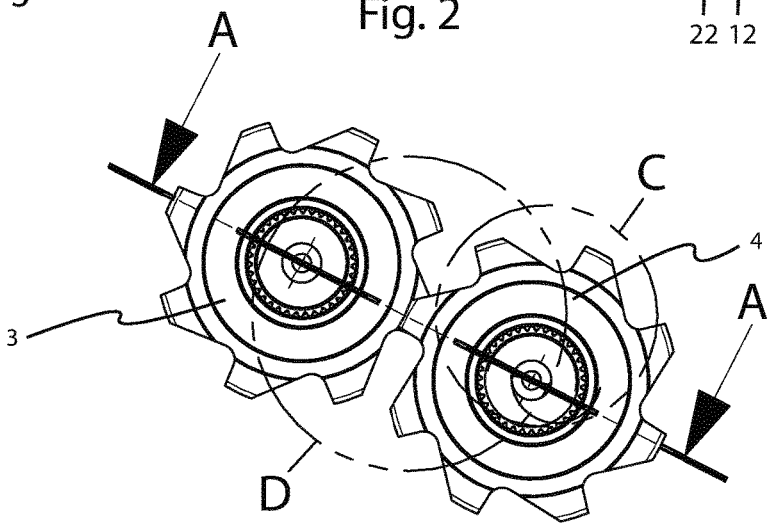
Figure 16:
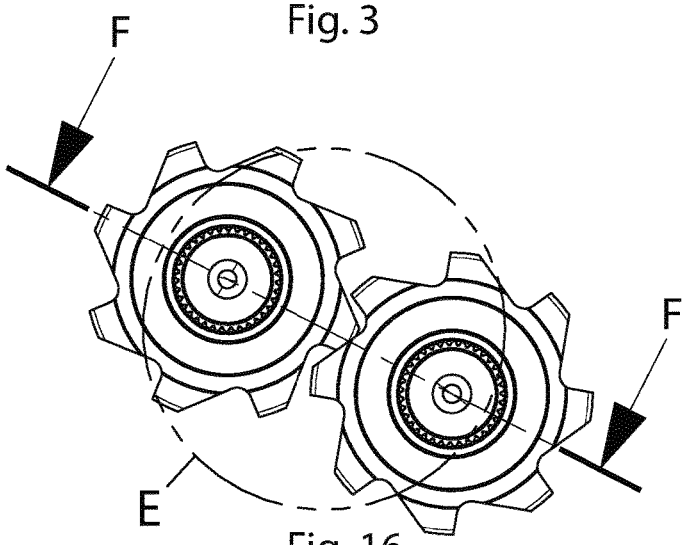

As mentioned, the shape of each roller 3, 4 controls the result of the compressing action. In the present embodiment, each of the first 3 and second 4 rollers comprises annular segments 10 arranged spaced apart in succession along the length of the respective roller 3, 4. Each annular segment extends from a base surface 23 of the respective roller 3, 4. As shown in FIGS. 2 and 4, most of said annular segments 10 of said first roller 3 extends between a respective pair of said annular segments 10 of the second roller 4, at least in the disclosed position of maximum overlap, illustrated in FIGS. 3, 4 and 7 and also referred to as a closed position. Upon further rotation of the rollers, the adjacent protruding elements 11 from each respective roller will start to move away from each other until they do not extend between each other, such that they are in a position referred to as an open position. Upon further rotation the next in line protruding elements 11 will move closer until the rollers 3, 4 are once more in a closed position.

The length of said overlap of the slanting portion may be at least 2.5 mm when the rollers 3, 4 are arranged with maximum overlap between two adjacent annular segments 10, i.e. in the closed position. Additionally, the separation distance between said slanting portions 17 of the first 3 and second 4 rollers which are facing each other is in the range of 0.4 to 3.0 mm.

As shown in FIG. 2, the leftmost segment 10 of the first roller 3 only overlaps with the leftmost segment 10 of the second roller 4, rather than extending between two segments of the second roller 4. The same situation applies to the rightmost segment of the second roller 4. As the skilled person understands, this depends on the number of segments of each roller 3, 4 and may in other embodiments alternatively vary accordingly. Hence, most of said annular segments 10 of said second roller 4 extends between a respective pair of said annular segments 10 of said first roller 3, at least in the closed position illustrated in FIGS. 3, 4 and 7.

Each annular segment 10 comprises protruding elements/teeth 11 arranged in succession circumferentially around the respective roller 3, 4. Each segment 10 thus forms a ring of teeth or protrusions 11.

Each protruding element 11 comprises a base 18 from which the protruding element 11 extends radially outwards. Also, each protruding element 11 comprises a leading surface 12, a trailing surface 13 arranged after said leading surface 12 in the respective direction of rotation 5, 6, a top surface 14 connecting said leading surface 12 and said trailing surface 13. Each protruding element also comprises a first 15 and a second 16 side surface respectively arranged on opposite sides of each protruding element 11 relative a plane intersecting a center of said top surface 14 and being orthogonal to the rotation axis 7 of the respective roller 3, 4. The top surface 14 is the surface comprising the radially outermost point of each protruding element 11.

Figure 5:
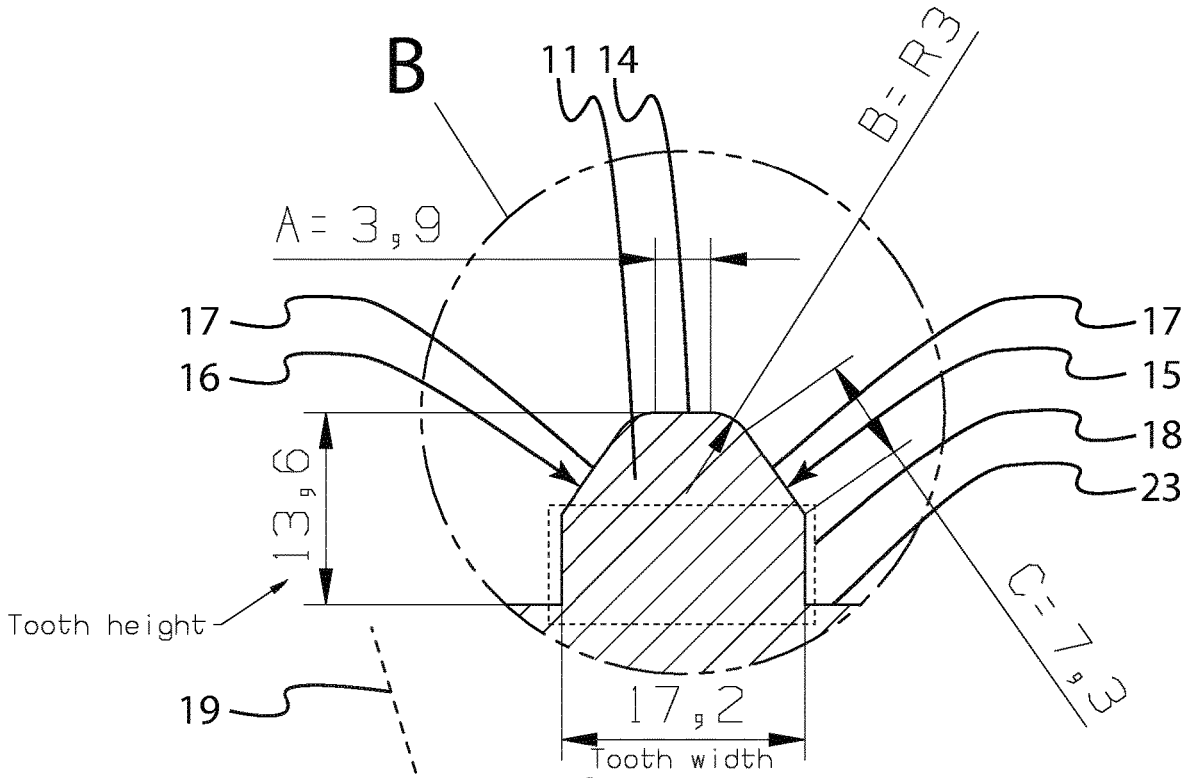
Figure 6:
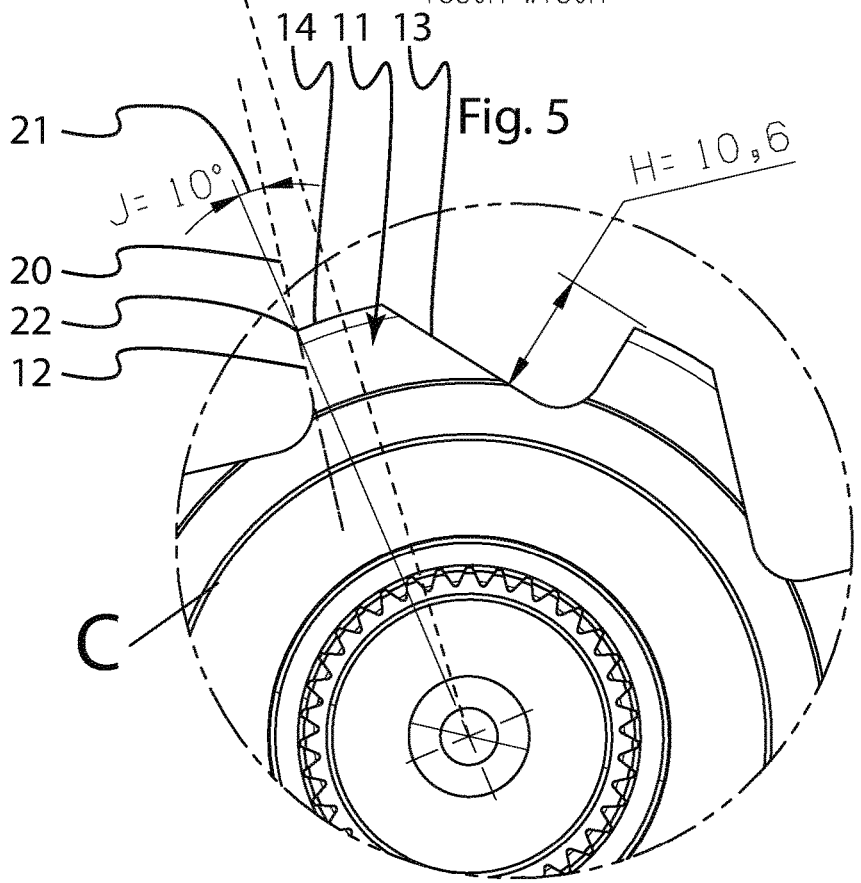

Each of said leading surface 12, said top surface 14 and said trailing surface 13 is planar, single curved or double curved. For example, turning of the roller in a lathe would produce double curved slanting side surfaces 15, 16 whilst machining by milling could produce planar, single curved or double curved surfaces. Here it should be understood that even if the cross-sectional shape as shown in FIGS. 4 and 5 is straight, the result from turning such a straight cross-sectional shape is a double curved surface. As indicated in FIGS. 4 and 6, the junction between said leading surface 12 and said top surface 14 forms a first ridge 22 for urging the emptied containers 9 between the rollers 3, 4. With reference to FIGS. 4 and 6, E=2*Rmax−AD, where E is the engagement value, Rmax is the maximum radius of the roller within said protruding element and AD is the distance between the respective rotation axis 7, 8 of said first 3 and second 4 rollers. Each of said side surfaces 15, 16 comprises a slanting portion 17, which slanting portion 17 is slanting outwards from said top surface 14 towards said base 18 and Lslanting>0.5*E, where Lslanting is the length of the slanting portion 17 in a center plane 19 (see FIG. 6) intersecting the center of said top surface 14 and the rotation axis 7, 8 of the roller 3, 4;

Rollers provided with segments comprising such protruding elements make the compressing arrangement 2 suitable for feeding and compressing containers 9 whilst preventing jam. Specifically, the slanting portions 17 facing each other in use apply force to the container 9 over a distributed surface with low risk of puncture of the container and therefore the container 9 is less prone to getting stuck to protruding elements 11. Further, the extra radial space given by providing an overlap less than the height of the protruding elements give extra space between adjacent segments for the material of the container 9 to move within at compression, thus further reducing concentration of stress in the container material and enabling compression without jamming.

Figure 17:
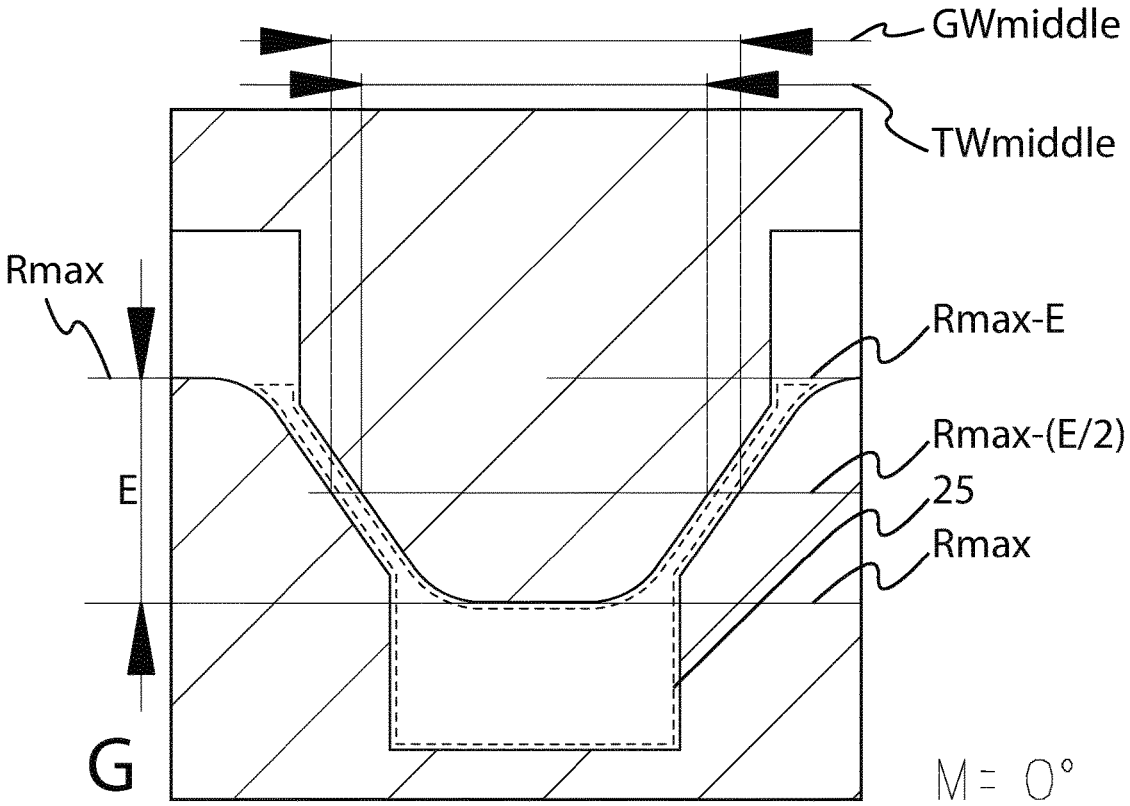
Figure 18:
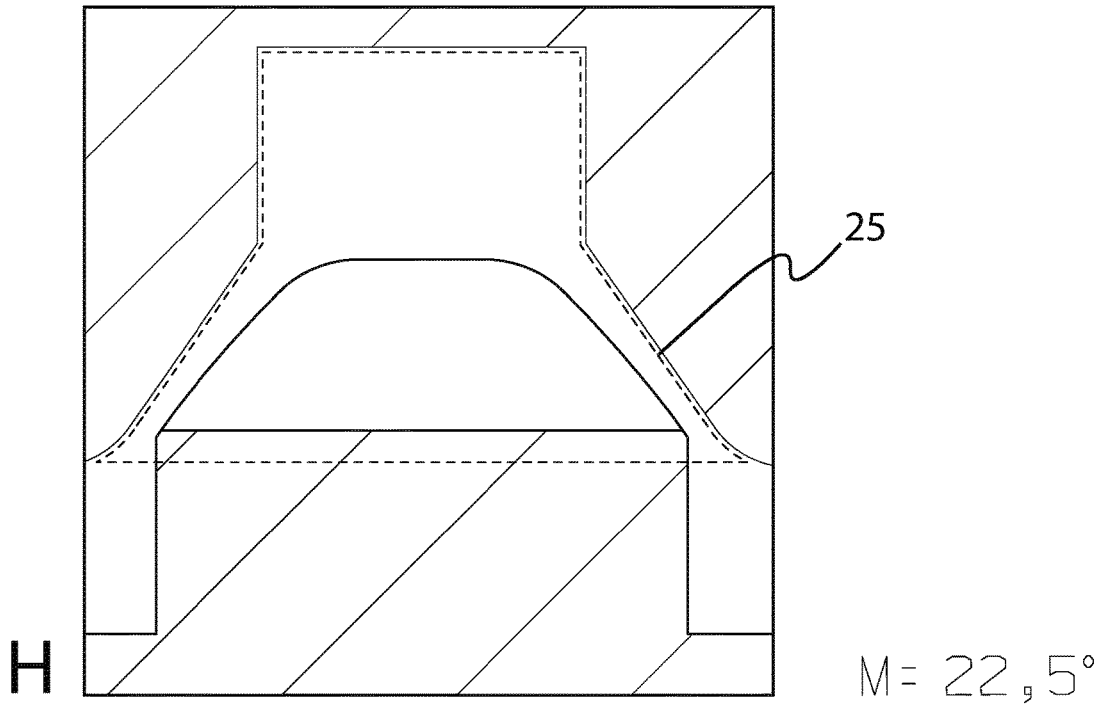
FIG. 18 shows enlarged detail view H as defined in FIG. 15 for M=25°.
Figure 19:
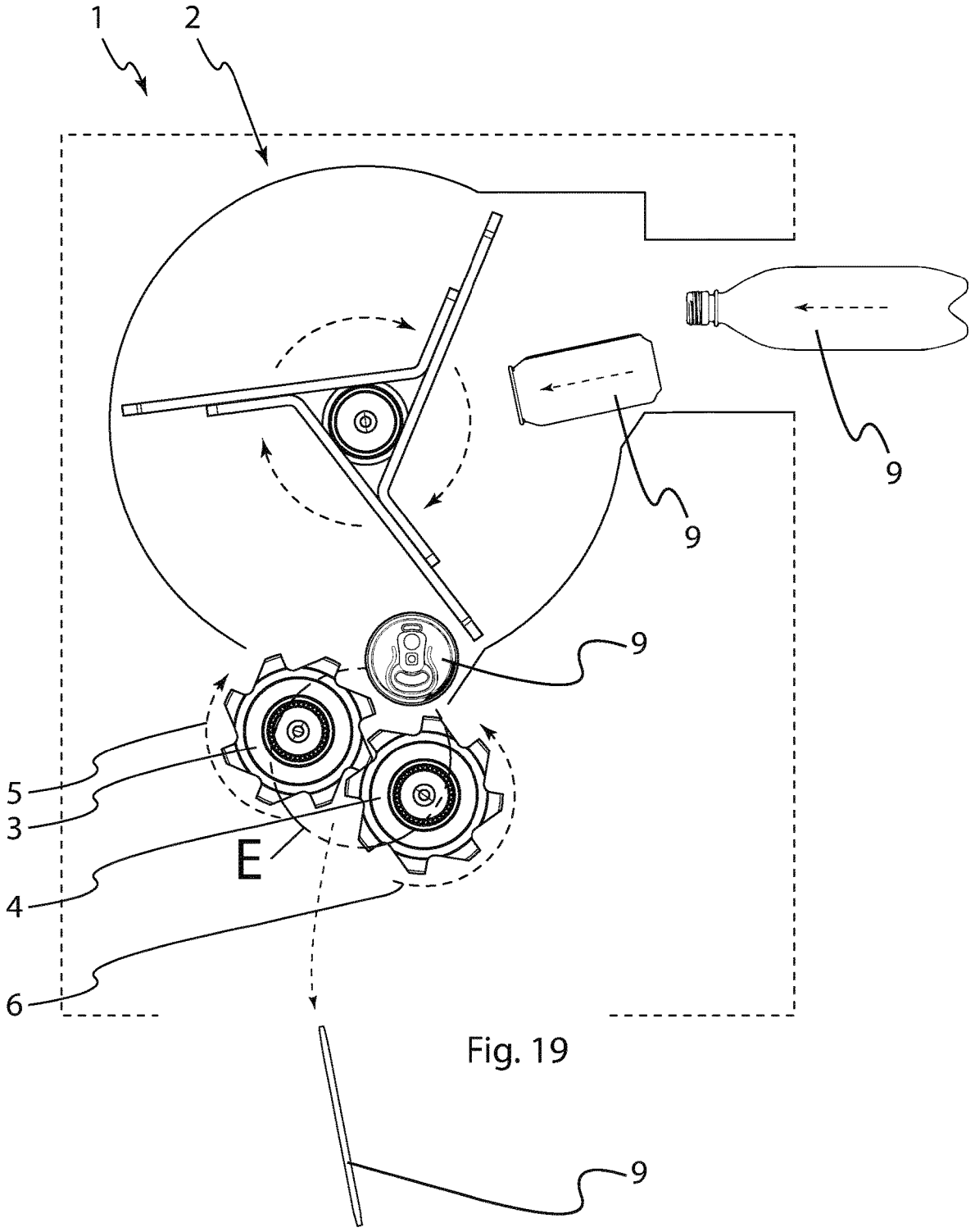
FIGS. 19-22 show views of an alternative embodiment in which each bent wave-shaped paddle is replaced with a flat paddle provided with pointy teeth.
Figure 20:
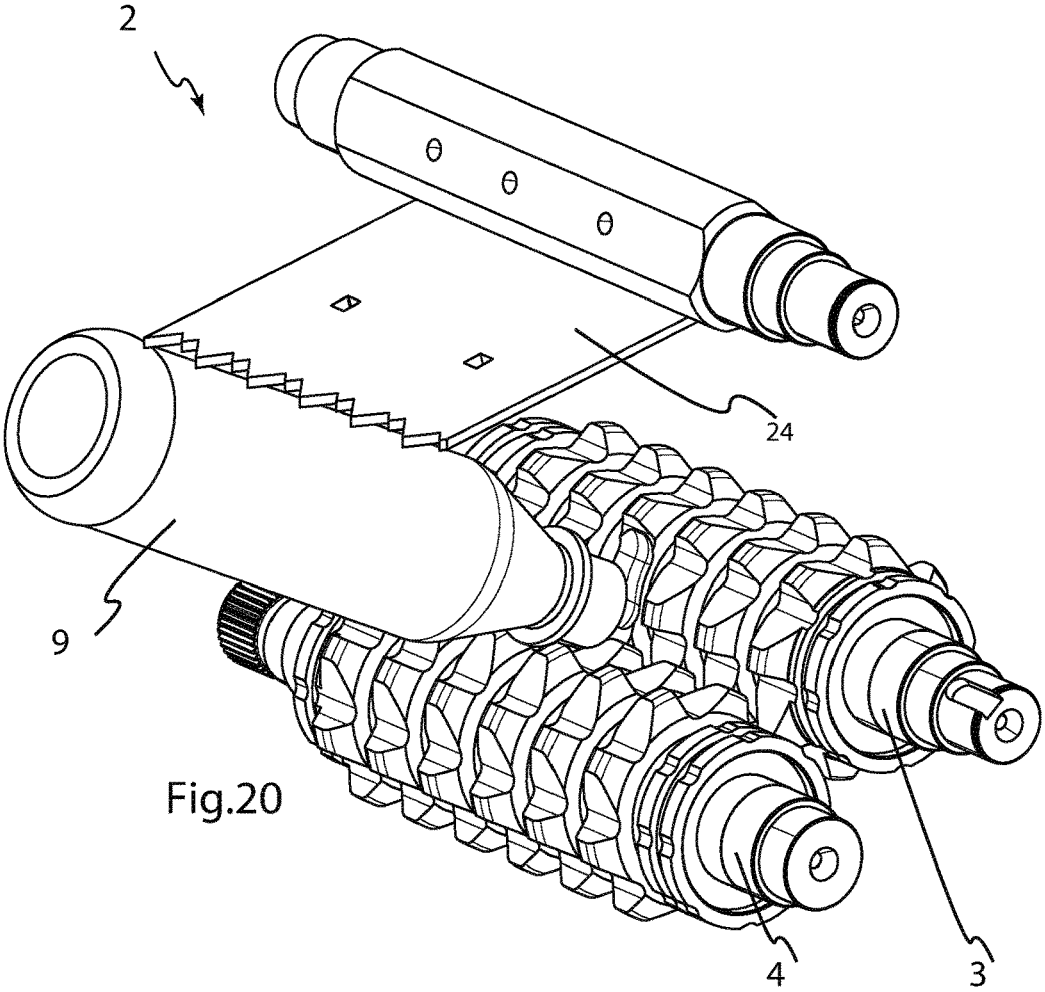
Figure 21:
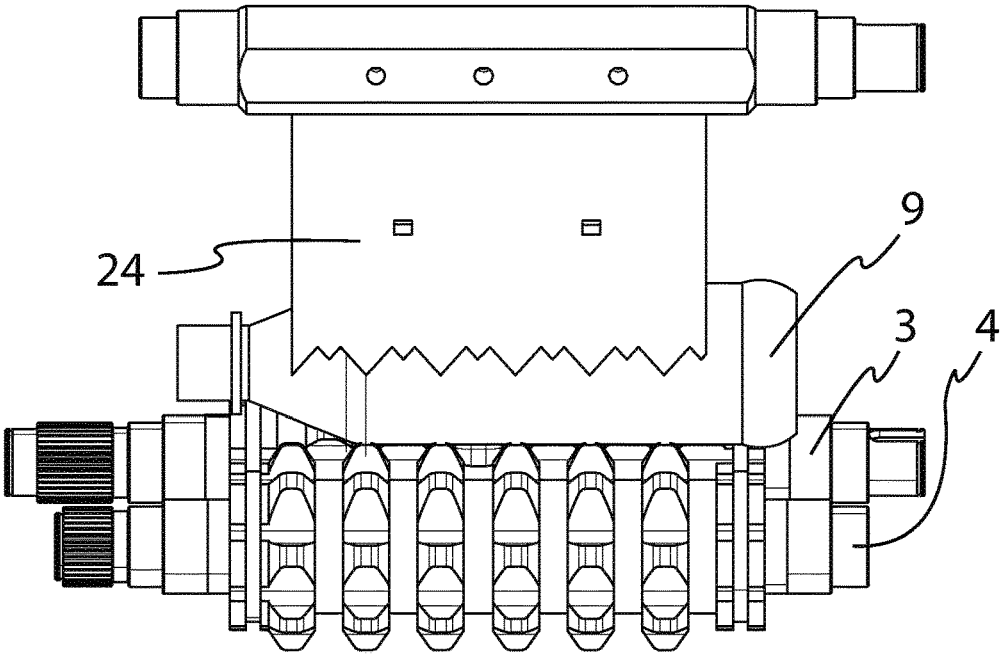

See enlarged portion of FIG. 4 in FIG. 5, in combination with FIG. 17, for guidance as to the definition of GWmiddle, TWmiddle and Rmax.

The device 1 for compression of emptied containers 9 may further be configured such that TWmiddle>0.9*GWmiddle, where TWmiddle is the distance between the first 15 and second 16 side surface in the axial direction of the protruding element 11 at a distance equal to Rmax−E/2 from the rotation axis 7, 8 of said roller 3, 4 in said center plane 19; and where GWmiddle is the shortest distance in the axial direction between said pair of annular segments 10 between which said protruding element 11 is arranged to pass, said shortest distance being determined at a distance equal to Rmax−E/2 from the rotation axis 7, 8 of the roller 3, 4 on which said pair of annular segments 10 is arranged.

The device 1 for compression of emptied containers 9 is configured such that annular segments 10 of said first roller 3 and the annular segments 10 of the second roller 4 mesh in such a way that a slanting portion 17 of the first roller 3 and a slanting portion 17 of the second roller 4 face each other and at least partly radially overlap each other when the rollers 3, 4 are arranged with maximum overlap between two adjacent annular segments 10, which two adjacent annular segments 10 are arranged on a respective one of said first and second rotatable rollers 3, 4.

Typically, the length of said overlap of said slanting portion 17 may be varied at least 2.5 mm when the rollers are arranged with maximum overlap between two adjacent annular segments. Additionally, or alternatively, the separation distance between said slanting portions which are facing each other may be at least 0.4 mm and at most 3.0 mm.

The leading surface 12 comprises a planar portion, which planar portion extends in a plane 20 comprising the axial direction. The planar portion forms an angle 21 of within the range of 10°, as shown in FIG. 6, but could alternatively vary between 0° to 20° to the radial direction in the direction of rotation 5, 6.

The slanting portion 17 comprises a double curved portion with a straight cross-sectional shape. The planar portion forms an angle 21 of 35° to the radial direction but could alternatively in other embodiments be within the range of 25° to 45°.

As shown in FIG. 5, the top surface 14 has a length in said axial direction of 3.9 mm, but could alternatively in other embodiments have a length of at least 1.8 mm or at least 2.8 mm or at least 3.8 mm; and/a length in said axial direction of at most 6.0 mm or at most 5 mm or at most 4.0 mm.

The top surface 14 is connected to said side surfaces 15, 16 by a respective convex surface. The convex surface has a radius of curvature of 3 mm but could in other embodiments alternatively have some other shape.

The difference in radial height between the highest and lowest surface of the annular segment 10 in the center plane is at least 6.5 mm or at least 8.5 mm or at least 9.5 mm. Additionally or alternatively, the difference in radial height between the highest and lowest surface of the annular segment 10 in the center plane 19 may be at most 15.0 mm or at most 13.0 mm or at most 11.0 mm.

The center-to-center distance L of two adjacent annular segments 10 on the same roller may be at least 12 mm or at least 20 mm or at least 27 mm; and/or wherein the center-to-center distance L of two adjacent annular segments 10 on the same roller is at most 44 mm or at most 36 mm or at most 29 mm.

The ratio between the height of the protruding element 11 and the width of the protruding element 11 in the axial direction is at least 0.5 or at least 0.6 or at least 0.7; and/or wherein the ratio between the height of the protruding element 11 and the width of the protruding element 11 in the axial direction is at most 1.2 or at most 1.0 or at most 0.8.

The meshing value E may be at least 4.0 mm or at least 6.0 mm or at least 7.0 mm, and/or the engagement value E may be at most 12.5 mm, or at most 10.5 mm or at most 10.2 mm.

As shown in FIG. 17, the cross-sectional area 25 of a cavity formed between two adjacent annular segments 10 of said first roller and a meshing protruding element of said second roller may be within the rage of 50 to 170 mm2 when the rollers are arranged with maximum overlap.

Each of said first and second rollers 3, 4 may, in use, have an offset angle M of at least 0° or at least 8° or at least 20°; and/or each of said first and second rollers 3, 4 may, in use, have an offset angle M of at most 33° or at most 28° or at most 23°.

The meshing value between two adjacent protruding elements 11 when the rollers 3, 4 are arranged with maximum overlap may be at least 4.0 mm or at least 6.0 mm or at least 7.0 mm, and/or the length of overlap in the radial direction between two adjacent protruding elements 11 when the rollers 3, 4 are arranged with maximum overlap may be at most 12.5 mm, or at most 10.5 mm or at most 10.2 mm.

As mentioned above, the paddles 24 follow a wave shape created by the top surface 14 and the side surfaces 15, 16. If the distance between the first roller 3 and the paddle 24 is increased by e.g. 1 mm, the gripping ability of the protruding elements 11 will decrease and the risk of containers 9 taking an extra turn around the paddle 24 shaft increases. 0.2 to 5 mm is a suitable range of distance.

The number of annular segments 10 is given by the geometry of the protruding elements 11 in relation to the defined width of the rollers 3, 4. A suitable number of annular segments 10 with this design of the protruding elements 11 is six, but could in other embodiments alternatively vary, for example in the range of 4 to 8 annular segments 10. The distance between the annular segments 10 is expressed by the parameter L as shown in FIG. 4.

The ridge 22 between the leading surface 12 and the top surface 14 functions to pierce the surface of large containers 9 such as PET bottles. If the width A of the top surface 14 is decreased, it becomes easier to penetrate the containers 9 and brings about a lower torque load on the motor driving the rollers (not illustrated). A reduced top surface width A makes it easier for the protruding element 11 to punch through the container wall. Punching the container wall may create sharp edges which may increase the risk of the container getting stuck on the protruding elements 11 of the rollers 3, 4.

The function of the rounded portion of the protruding element 11 defined by radius B is to create a rounded edge so that metal containers 9, such as metal cans, are not cut. A reduced radius causes more tearing of the container 9 walls whilst an increased radius makes it more difficult to penetrate large and thick PET bottle containers 9.

In some embodiments, the paddles may alternatively be planar rather than bent, as shown in FIGS. 19-22 and further described below. The straight/planar paddle design exerts a more aggressive force on the bottles, compared to bent paddles. This helps capturing the bottles and deliver them in a controlled manner to the knives. A paddle edge consisting of a repeating pattern of large and small pointy tips helps grabbing the elastic PET bottles and prevents the bottle from slipping out of the paddle grip.

The size of the side surfaces 15, 16 of each protruding element 11 is related to the compaction efficiency of the rollers 3, 4. Specifically, the size of the side surfaces 15, 16 and the angle D define a "wave pattern" between the rollers 3, 4, which helps permanently deforming the containers 9.

The angle D of side surfaces 14, 15 (see FIG. 4) affects the relation between the top surface 14 surfaces A, C and the "Inner Diameter" of the roller 3, 4. The sinusoidal curve brings about an even transition in pressure over the container 9. If angle D is too small, metal can containers 9 will tear up at the corners (around area B).

The "Tooth overlap" determined by parameter E determines whether or not the rollers 3, 4 will succeed in permanently deforming plastic containers 9 which, compared to metal containers 9, are relatively elastic. If E is too small, the compression will eventually not overcome the elasticity of some plastic containers 9, such as PET bottles, and the container 9 will return to its original shape after passing between the rollers 3, 4.

Parameter F as shown in FIG. 4 defines the spacing/free distance between opposite side surfaces 14, 15. If the spacing is too small, large containers 9 or containers 9 with thick material may struggle passing through the rollers 3, 4. The free distance F between adjacent slanting surfaces of meshing teeth of adjacent rollers is typically within the range of 2.9 mm to 0.5 mm, preferably between 1.5 mm and 0.7 mm.

Parameter H as shown in FIG. 4 defines the height of the protruding element 11. The height H affects the rollers' ability of gripping containers 9, especially PET bottles fed in with their bottle neck first. If the height H of the protruding element 11 is increased, the protruding element 11 risks puncturing metal containers too much such that the container 9 gets stuck on the protruding element 7, which may eventually lead to jamming. Also, a reduction of the width of the protruding element 11 leads to easier cutting of the container and thus to increased risk of unintentional cutting of the container 9.

Parameter J as shown in FIG. 6 defines the angle of attack or the protruding element 11. The angle J affects the gripping ability of the rollers 3, 4, especially for plastic containers 9 such as PET bottles. A lower value for J leads to improved gripping ability but may however also cause metal can containers 9 to stick to the rollers 3, 4 thereby prohibiting the containers 9 to exit the compression device 1. A value for J of about 10 degrees is considered suitable for most common drinking containers 9, such as metal cans and PET bottles.

Figure 7:
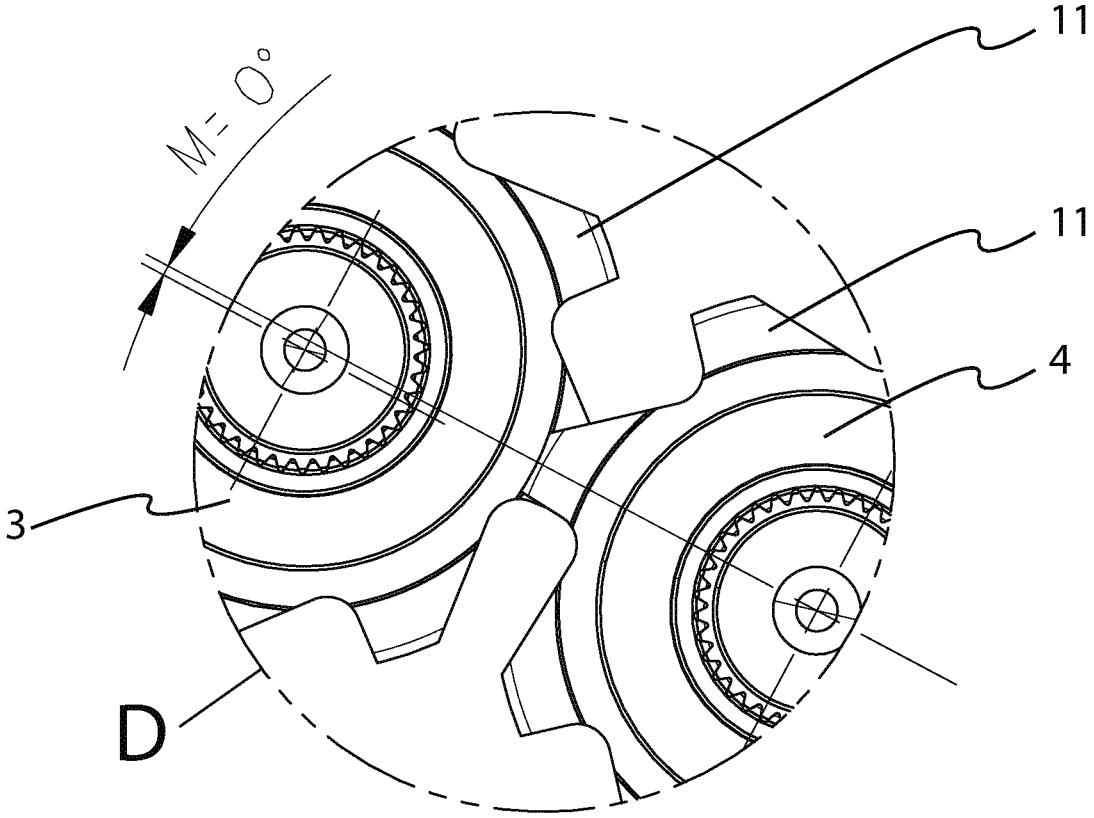
Figure 8:
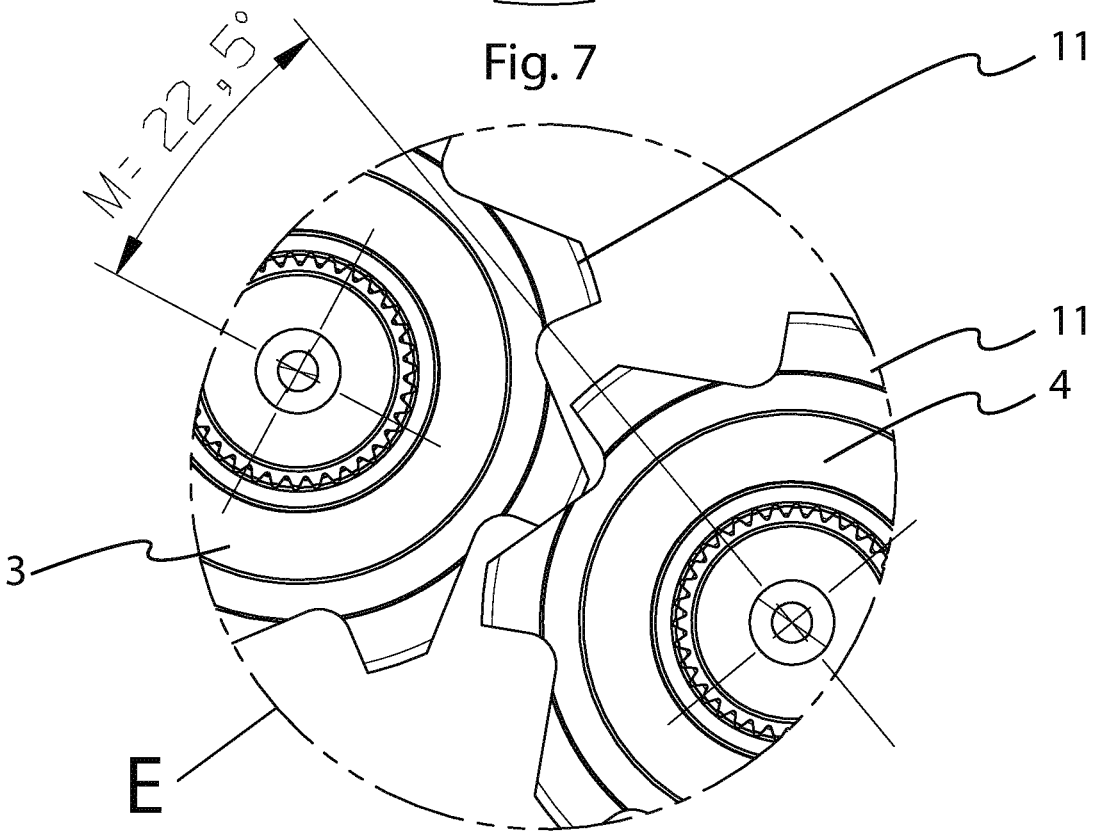
Figure 9:
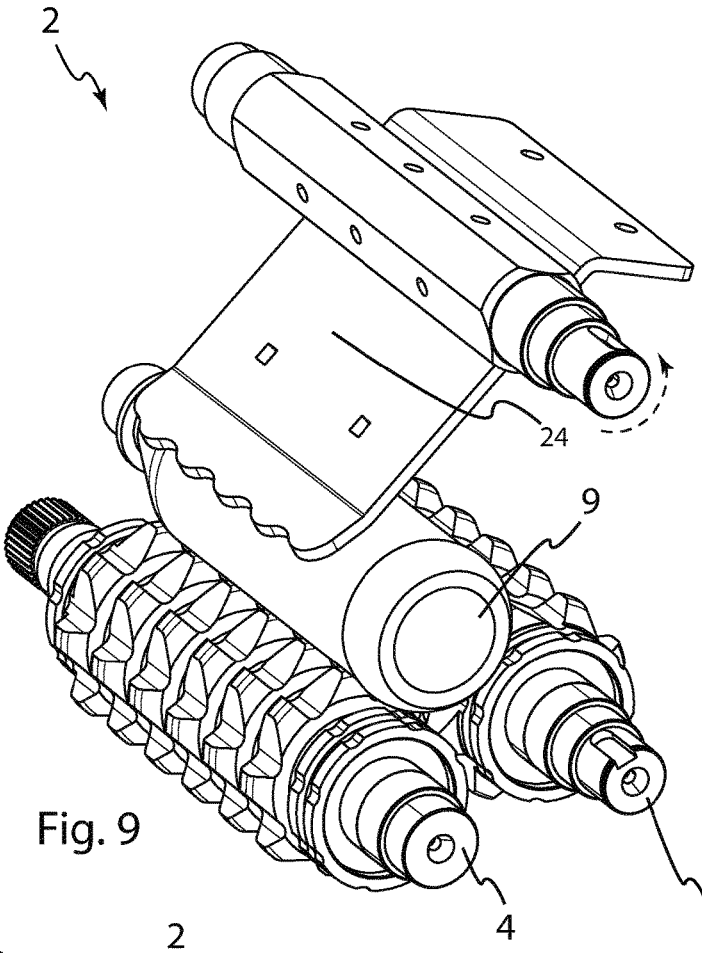
Figure 10:
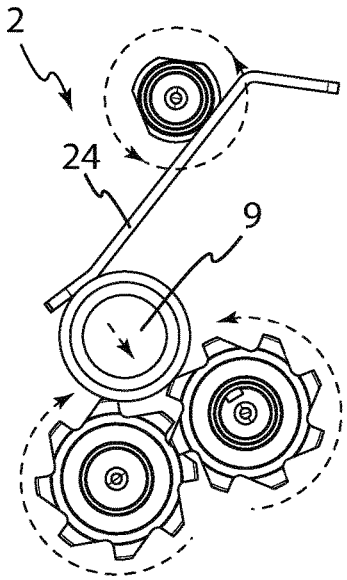

Parameter M, as shown in FIGS. 7-8 describe the angular offset correlation between two cooperating rollers 3, 4. The smaller the value M, the better the gripping of PET bottles. At the same time, the torque needed to rotate the rollers 3, 4 increases with smaller value of M. A suitable offset angle M in 22.5 degrees.

As mentioned above, the parameters may be adjusted between different embodiments in order to adjust performance of the rollers as desired to suit different types of containers 9.

Figure 15:
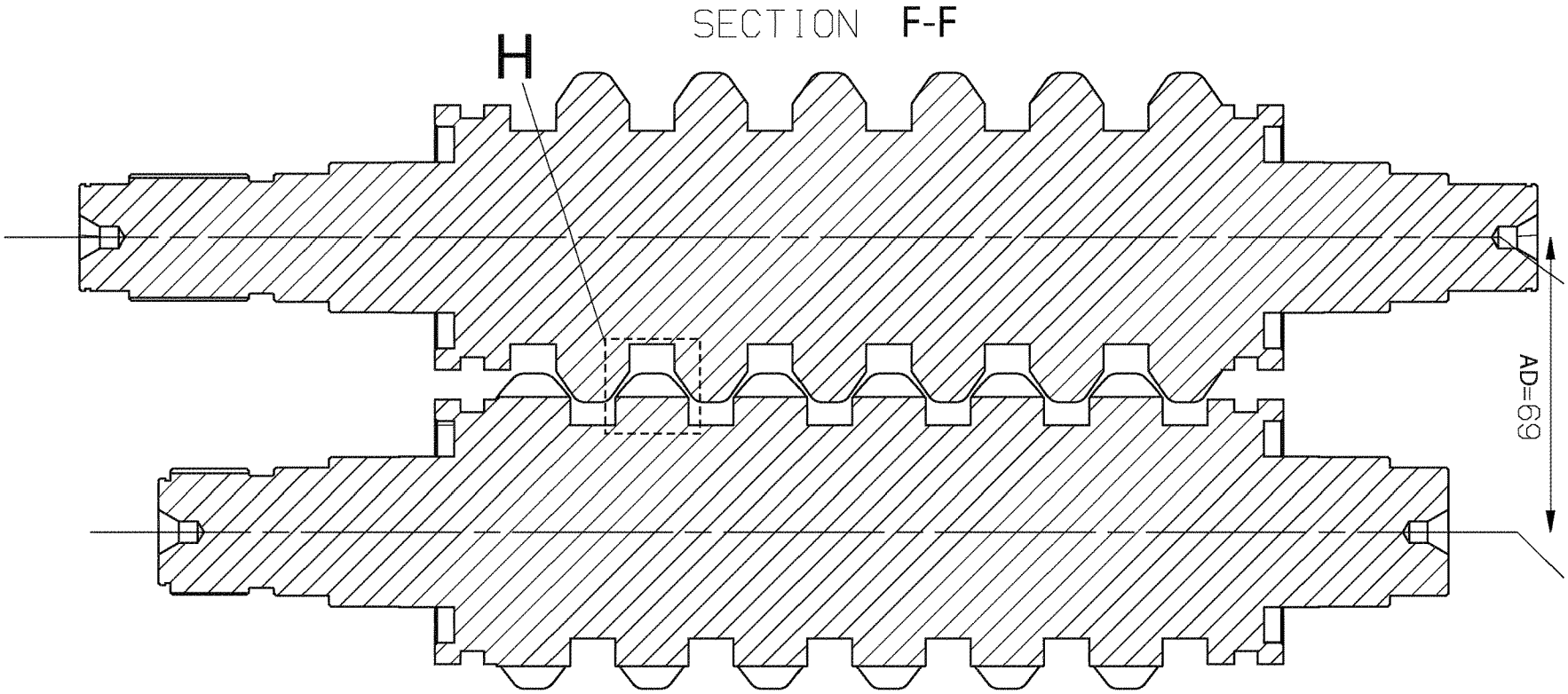

As shown in FIG. 15 the rollers 3, 4 may be used with a radial offset set to M=22.5 degrees.

As explained above, the engagement value E corresponds to the meshing depth or the overlap between the protruding elements when the radial offset M is 0 degrees. When M is 22.5 degrees, the actual overlap is close to 0 in the cross-section F-F shown in FIG. 15, i.e. much smaller than E. Independent of the choice of radial offset M, E is always 2*Rmax-AD.

Figure 22:
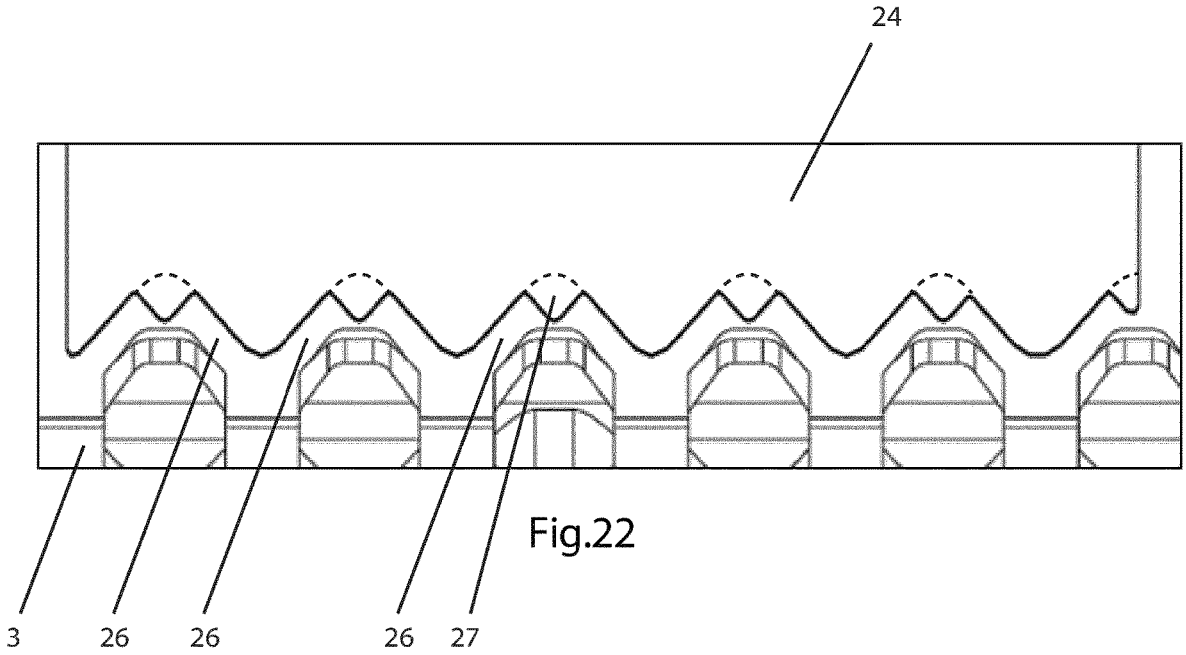

An aspect of this disclosure relates to a new alternative design of the paddle used in the embodiments of the compression device described above. This new paddle design is generally applicable also to other compression devices with pairs of rollers provided with teeth having other geometries than the geometries described above. The new paddle design is shown is FIGS. 19-22 and described in relation thereto, however together with an optional compression device as described above. The new paddle 24 comprises an attachment portion for attachment of the paddle to a rotatable shaft or hub. As best shown in FIG. 22, the new paddle 24 also comprises an outer portion comprising a series of spaced-apart recesses 26. Each one of the spaced-apart recesses 26 is for receiving a respective tooth of an annular segment 10 of one of the rotatable rollers 3, 4 of the compression device 1. A central bottom portion of each recess 26 is provided with a feeding tooth 27. The feeding tooth 27 extends into the recess 26 away from the attachment portion of the paddle 24. The exact shape of the feeding tooth 27 may vary to the one depicted but it should preferably be narrow and/or pointed. An effect of this is that the feeding tooth 27 is able to locally apply a high enough pressure on the wall of a container squeezed between the paddle 24 and the roller 3, 4 to thereby grip the container for feeding the container towards the gap between the two rollers 3, 4.

In other words:

A feeding paddle for a container compressing device comprising pair of compression rollers 3, 4, wherein the feeding paddle comprises an attachment portion for attachment of the paddle to a rotatable shaft or hub, an outer portion comprising a series of spaced-apart recesses, wherein a central bottom portion of each recess 26 is provided with a feeding tooth 27.

Also, a device 1 for compression of emptied containers 9, said device 1 comprising a container compressing arrangement 2 comprising:

a first 3 and a second 4 rotatable roller, each of said first 3 and second 4 rotatable rollers is configured to rotate in a respective direction of rotation 5, 6 around a respective rotation axis 7, 8, said first 3 and second 4 rollers are arranged adjacent to each other and with the rotational axes 7, 8 in parallel, the direction of rotation 5 of said first roller being opposite to the respective direction of rotation 6 of said second roller so that the first 3 and second 4 rollers cooperate in the feeding of containers 9 between the rollers 3, 4, wherein each of said first 3 and second 4 rollers comprises annular segments 10 arranged spaced apart in succession along the length of the respective roller 3, 4 in an axial direction coinciding with said respective rotation axis 7, 8, wherein each of said annular segments 10 of said first roller 3 extends between a respective pair of said annular segments 10 of the second roller 4, and wherein each of said annular segments 10 of said second roller 4 extends between a respective pair of said annular segments 10 of said first roller 3, wherein each annular segment 10 comprises protruding elements/teeth 11 arranged in succession circumferentially around the respective roller 3, 4, and wherein the device further comprises a plurality of paddles 24 provided above said rollers 3, 4 for feeding containers 9 from an inlet of the device 1 towards the rollers 3, 4, wherein each feeding paddle comprises an attachment portion for attachment of the paddle to a rotatable shaft or hub, an outer portion comprising a series of spaced-apart recesses 26, wherein each one of the spaced-apart recesses 26 is for receiving a respective tooth of an annular segment 10 of one of the rotatable rollers 3, 4 of the compression device 1, wherein a central bottom portion of each recess 26 is provided with a feeding tooth 27.

The invention claimed is:

1. A device configured to compress emptied metal containers and emptied plastic containers, said device comprising a container compressing arrangement comprising:

a first and a second rotatable roller, each of said first and second rotatable rollers is configured to rotate in a respective direction of rotation around a respective rotation axis, said first and second rollers are arranged adjacent to each other and with the rotational axes in parallel, the direction of rotation of said first roller being opposite to the respective direction of rotation of said second roller so that the first and second rollers cooperate in feeding of the containers between the rollers, wherein each of said first and second rollers comprises annular segments arranged spaced apart in succession along the length of the respective roller in an axial direction coinciding with said respective rotation axis, wherein each of said annular segments of said first roller extends between a respective pair of said annular segments of the second roller, and wherein each of said annular segments of said second roller extends between a respective pair of said annular segments of said first roller, wherein each annular segment comprises:

protruding elements arranged in succession circumferentially around the respective roller, and each protruding element comprises a base from which the protruding element extends radially outwards, wherein each protruding element comprises a leading surface, a trailing surface arranged after said leading surface in the respective direction of rotation, a top surface connecting said leading surface and said trailing surface, and a first and a second side surface respectively arranged on opposite sides of each protruding element relative to a plane intersecting a center of said top surface and being orthogonal to the rotation axis of the respective roller; wherein each of said leading surface, said top surface and said trailing surface is planar or single curved, the junction between said leading surface and said top surface forms a first ridge for urging the emptied containers between said rollers, each of the protruding elements of one of said first and second rollers is arranged to pass between a respective pair of annular segments of the other of said first and second rollers; wherein E=2*Rmax AD, where E is the engagement value, Rmax is the maximum radius of the roller within said protruding element and AD is the distance between the respective rotation axis of said first and second rollers;

each of said side surfaces comprises a slanting portion, which slanting portion is slanting outwards from said top surface towards said base and Lslanting >0.5*E, where Lslanting is the length of said slanting portion in a center plane intersecting the center of said top surface and the rotation axis of the roller, wherein TWmiddle >0.8* GWmiddle, where TWmiddle is the distance between the first and second (16) side surface in the axial direction of the protruding element at a distance equal to Rmax−E/2 from the rotation axis of said roller in said center plane, and GWmiddle is the shortest distance in the axial direction between said pair of annular segments between which said protruding element is arranged to pass, said shortest distance being determined at a distance equal to Rmax−E/2 from the rotation axis of the roller on which said pair of annular segments is arranged.

2. The device for compression of emptied containers according to claim 1, wherein a free distance between adjacent slanting surfaces of meshing protruding elements of adjacent rollers is within the range of 2.9 mm to 0.5 mm.

3. The device for compression of emptied containers according to claim 1, wherein an outer portion of each one of said protruding elements has a smooth profile in said center plane wherein said smooth profile is formed by a selection of flat surfaces, rounded surfaces and corners with corner angles larger than 120 degrees.

4. The device for compression of emptied containers according to claim 1, wherein said leading surface comprises a planar portion, which planar portion extends in a plane comprising said axial direction, wherein said planar portion forms an angle within the range of 0° to 20° to the radial direction in the direction of rotation.

5. The device for compression of emptied containers according claim 4, wherein said slanting portion comprises a planar portion, which planar portion extends in a plane transverse to said axial direction, wherein said planar portion forms an angle larger than 25° to the radial direction.

6. The device for compression of emptied containers according to claim 4, wherein said planar portion of said side surface has a length of at least 4.0 mm.

7. The device for compression of emptied containers according claim 4, wherein said slanting portion comprises a planar portion, which planar portion extends in a plane transverse to said axial direction, wherein said planar portion forms an angle smaller than 45° to the radial direction.

8. The device for compression of emptied containers according to claim 4, wherein said planar portion of said side surface has a length of at most 11.0 mm in the center plane.

9. The device for compression of emptied containers according to claim 1, wherein the top surface has a length in said axial direction of at least 1.8 mm.

10. The device for compression of emptied containers according to claim 1, wherein the top surface is connected to said side surfaces by a respective convex surface, said convex surface optionally having a radius of curvature of at least 1 mm.

11. The device for compression of emptied containers according to claim 1, wherein the difference in radial height between the highest and lowest surface of the annular segment in a plane orthogonal to the rotational axis and intersecting the top surfaces of an annular segment is at least 6.5 mm.

12. The device for compression of emptied containers according to claim 1, wherein the center-to-center distance of two adjacent annular segments on the same roller is at least 12 mm.

13. The device for compression of emptied containers according to claim 1, wherein the ratio between the height of the protruding element and the width of the protruding element in the axial direction is at least 0.5.

14. The device for compression of emptied containers according to claim 1, wherein said engagement value (E) is at least 4.0 mm.

15. The device for compression of emptied containers according to claim 1, wherein said first and second rollers in use form an offset angle (M) between respective protruding elements of the first and second rollers of at least 0° and at most 33°.

16. The device for compression of emptied containers according to claim 1, wherein the engagement value between two adjacent protruding elements when the rollers are arranged with maximum overlap is at least 4.0 mm.

17. The device for compression of emptied containers according to claim 1, wherein the area of a cavity formed between two adjacent annular segments of said first roller and a meshing protruding element of said second roller may be at least 50 $mm^2$ when the rollers are arranged with maximum overlap.

18. The device according to claim 1, wherein said device is a reverse vending machine configured to handle both emptied metal containers and emptied plastic containers.

19. The device for compression of emptied containers according to claim 1, wherein the top surface has a length in said axial direction of at most 6.0 mm.

20. The device for compression of emptied containers according to claim 1, wherein the top surface is connected to said side surfaces by a respective convex surface, said convex surface optionally having a radius of curvature of at most 5 mm.

21. The device for compression of emptied containers according to claim 1, wherein the difference in radial height between the highest and lowest surface of the annular segment in a plane orthogonal to the rotational axis and intersecting the top surfaces of an annular segment is at most 15.0 mm.

22. The device for compression of emptied containers according to claim 1, wherein the center-to-center distance of two adjacent annular segments on the same roller is at most 36 mm.

23. The device for compression of emptied containers according to claim 1, wherein the ratio between the height of the protruding element and the width of the protruding element in the axial direction is at most 1.2.

24. The device for compression of emptied containers according to claim 1, wherein said engagement value (E) is at most 12.5 mm.

25. The device for compression of emptied containers according to claim 1, wherein the engagement value between two adjacent protruding elements when the rollers are arranged with maximum overlap is at most 12.5 mm.

26. The device for compression of emptied containers according to claim 1, wherein the area of a cavity formed between two adjacent annular segments of said first roller and a meshing protruding element of said second roller may be at most 170 $mm^2$ when the rollers are arranged with maximum overlap.

* * * * *